US009510406B2

(12) United States Patent
McRae

(10) Patent No.: US 9,510,406 B2
(45) Date of Patent: Nov. 29, 2016

(54) SYSTEM FOR CONTROLLING LED LIGHT STRINGS

(71) Applicant: NCP Corporation, Cranford, NJ (US)

(72) Inventor: Michael McRae, Ormond Beach, FL (US)

( * ) Notice: Subject to any disclaimer, the term of this patent is extended or adjusted under 35 U.S.C. 154(b) by 0 days.

(21) Appl. No.: 14/565,701

(22) Filed: Dec. 10, 2014

(65) Prior Publication Data

US 2015/0091454 A1 Apr. 2, 2015

Related U.S. Application Data

(63) Continuation-in-part of application No. 13/694,755, filed on Dec. 31, 2012, now Pat. No. 8,941,312, which is a continuation-in-part of application No. 12/930,892, filed on Jan. 19, 2011, now Pat. No. 8,450,950.

(60) Provisional application No. 61/631,205, filed on Dec. 29, 2011, provisional application No. 61/296,258, filed on Jan. 19, 2010, provisional application No. 61/460,048, filed on Dec. 23, 2010.

(30) Foreign Application Priority Data

Oct. 18, 2010 (CN) ..... 2010 2 0565253 U

(51) Int. Cl.
*H05B 33/08* (2006.01)
*H05B 37/02* (2006.01)

(52) U.S. Cl.
CPC ..... *H05B 33/0815* (2013.01); *H05B 33/0806* (2013.01); *H05B 33/0857* (2013.01); *H05B 37/0272* (2013.01)

(58) Field of Classification Search
CPC .... F21V 23/04; F21S 41/001; B23K 11/248; H05B 33/0815
USPC ..... 315/186, 193, 291, 362
See application file for complete search history.

(56) References Cited

U.S. PATENT DOCUMENTS

| | | | | |
|---|---|---|---|---|
| 5,734,116 | A * | 3/1998 | Schaeffer | G08G 1/097 340/931 |
| 6,211,626 | B1 * | 4/2001 | Lys | A61N 5/0616 315/291 |
| 6,459,919 | B1 * | 10/2002 | Lys | A61N 5/0616 315/291 |
| 8,198,831 | B2 * | 6/2012 | Matsuoka | H05B 33/0809 315/291 |
| 8,517,562 | B2 * | 8/2013 | Harbers | H05B 33/0803 362/223 |
| 2002/0181250 | A1 * | 12/2002 | Riggio | H01F 3/10 363/16 |
| 2009/0189533 | A1 * | 7/2009 | Hsu | F21S 4/001 315/185 S |
| 2013/0049484 | A1 * | 2/2013 | Weissentern | H02J 5/005 307/104 |

* cited by examiner

*Primary Examiner* — Douglas W Owens
*Assistant Examiner* — Syed M Kaiser
(74) *Attorney, Agent, or Firm* — James M. Smedley LLC; James Michael Smedley, Esq.

(57) ABSTRACT

An enhanced control mechanism for an LED light string system is provided for switching between one of two DC output phases or polarities so as to actuate one or the other of two LEDs within the bulbs on the light string. The control mechanism is further configured to allow switching so as to pass through the input power provided by a high-to-low voltage converter that is plugged into its electrical power feeding end. The control mechanism may then provide rectified AC voltage, or DC voltage, of various switched values to the LED string according to the particular needs of the LED bulbs.

20 Claims, 13 Drawing Sheets

SYSTEM FOR CONTROLLING LED LIGHT STRINGS

RELATED APPLICATIONS

This application is a continuation-in-part of and claims priority to U.S. patent application Ser. No. 13/694,755, entitled "Apparatus and method for controlling LED light strings" filed Dec. 31, 2012, the contents of which is herein incorporated by reference in its entirety.

U.S. patent application Ser. No. 13/694,755, in turn, claims priority to U.S. Provisional Patent Application Ser. No. 61/631,205, titled "Method and Apparatus for Controlling an LED Light String", filed on Dec. 29, 2011, and is a continuation-in-part of and claims priority to U.S. patent application Ser. No. 12/930,892, entitled "Apparatus and Method for Controlling LED Light Strings" filed Jan. 19, 2011, which in turn, claims priority to the U.S. Provisional Patent Application Ser. No. 61/296,258, titled "Adapter for Coordinating Illumination of Multi-Color LED Lighting String Displays", filed on Jan. 19, 2010; the U.S. Provisional Patent Application Ser. No. 61/460,048, titled "Apparatus and Method for LED Light String Connection", filed on Dec. 23, 2010; and the Chinese Patent Application Serial No. 201020565253, titled "One Bulb Dual Color LED Controlled Circuitry", filed on Oct. 18, 2010, the contents of all of which are herein incorporated by reference in their entirety.

FIELD OF THE INVENTION

The disclosure relates generally to controlling a light emitting diode (LED) light string where pairs of LEDs are connected to each other in an antiparallel configuration such that one or the other LED illuminates depending on the polarity of the voltage applied to the light string. More specifically, a rectifier is provided so that a low voltage AC signal is converted to a DC signal. The polarity of the DC signal applied to the light string is controlled by a switching circuit. The rectifier may also be bypassed by the switching circuit so that an AC signal is applied to the LED light string, giving the appearance of both LEDs being illuminated simultaneously. Furthermore, the system allows for multiple light strings to be coupled together and be independently controlled or set to follow the control signal of a master controller.

BACKGROUND OF THE INVENTION

Various LED light strings have been proposed for decorative illumination purposes. One type of LED light string takes advantage of the fact that LEDs only illuminate when a voltage is applied in the correct direction. By coupling two LEDs together in parallel, anode to cathode and cathode to anode, so that only one of the LEDs will light with each voltage polarity, a dual color light string can be created. This type of light string may emit white light when a positive voltage is applied and multi-colored light when a negative voltage is applied. While multiple variations of this kind of dual-polarity LED light string are known, a system for providing the control functions required to produce the desired lighting effects has not been disclosed.

In addition, when multiple dual-polarity LED light strings are connected together, it is desirable to have each light string configurable to follow the control signal of the light system it is attached to or to work independently, allowing for a variety of lighting effects.

Thus the need exists to provide for an LED light string controller that is capable of controlling and coordinating the illumination of the LEDs within the string, particularly with respect to the control of color. Further, one master LED light controller would ideally provide such control functions in an arrangement containing multiple LED light strings, while the controllers for the other light strings followed or mirrored the color selection made by the master controller.

SUMMARY OF THE INVENTION

Accordingly, it is an object of the present invention to provide a controller for an LED light string which provides a forward voltage bias which lights one color of LEDs, a reverse voltage bias which lights another color of LEDs, and various other lighting effects. The LED light string is formed by a plurality of LED pairs, each pair formed by coupling two LEDs together in parallel, anode to cathode.

It is also an object of the present invention to provide a system for connecting multiple LED light strings together such that the control signal from one controller is passed to the other LED light strings, allowing control of all light strings from a single controller.

It is also an object of the present invention to provide a system which allows each LED light string to operate independently, or follow a common control signal, according the user preference.

According to one embodiment of the present invention, an LED light control system comprises a first electrical connection, a second electrical connection, a multi-function generator, and a primary switching circuit having a plurality of switch states comprising: a first switch state providing a pass-through from the first electrical connection to the second electrical connection, a second switch state providing the output of the multi-function generator to the second electrical connection.

According to one embodiment of the present invention, the plurality of switch states further comprise a third switch state providing a reverse pass-through from the first electrical connection to the second electrical connection.

According to one embodiment of the present invention, the LED light control system further comprises an LED light string configured to electrically connect to the second electrical connection, the LED light string comprising a plurality of LED pairs, each pair having a first color LED and a second color LED connected to each other in parallel, anode to cathode.

According to one embodiment of the present invention, the LED light control system further comprises an LED light string, the LED light string comprising a plurality of LED pairs, each pair having a first color LED and a second color LED connected to each other in parallel, anode to cathode; and a second switching circuit configured to electrically connect to the LED light control system, the second switching circuit having a second plurality of switch states comprising: a first switch state providing a pass-through of an input signal, a second switch state providing a reverse pass-through of the input signal.

According to one embodiment of the present invention, the LED light control system further comprises a third electrical connection, an LED light string, the LED light string comprising a plurality of LED pairs, each pair having a first color LED and a second color LED connected to each other in parallel, anode to cathode; a rectifier, and a second switching circuit electrically connected to the rectifier, the second switching circuit having a second plurality of switch states comprising: a first switch state providing a forward voltage bias from the rectifier to the third electrical connection, and a second switch state providing a reverse voltage bias from the rectifier to the third electrical connection.

According to one embodiment of the present invention, the second plurality of switch states further comprises: a third switch state providing a pass-through to the third electrical connection, bypassing the rectifier.

According to one embodiment of the present invention, the LED light control system further comprises an LED light string, the LED light string comprising a plurality of LED pairs, each pair having a first color LED and a second color LED connected to each other in parallel, anode to cathode; a rectifier, a second multi-function generator electrically connected to the rectifier, and a second switching circuit electrically connected to the rectifier and electrically connected to the second multi-function generator, the second switching circuit having a second plurality of switch states comprising: a first switch state providing an output from the multi-function generator, a second switch state providing a pass-through of an input signal, bypassing the rectifier and the multi-function generator.

According to one embodiment of the present invention, an LED light control system comprises a first electrical connection, a second electrical connection, a rectifier electrically connected to the first electrical connection, a multi-function generator electrically connected to the rectifier, a primary switching circuit having a plurality of switch states comprising: a first switch state providing an output of the multifunction generator to the second electrical connection a second switch state providing an operating output to the second electrical connection other than from the multifunction generator.

According to one embodiment of the present invention, the second switch state provides an output from the rectifier.

According to one embodiment of the present invention, the second switch state provides a pass-through from the first electrical connection to the second electrical connection, bypassing the rectifier.

According to one embodiment of the present invention, the multi-function generator is configured to generate a DC output.

According to one embodiment of the present invention, the LED light control system further comprises an LED light string, the LED light string comprising a plurality of LED pairs, each pair having a first color LED and a second color LED connected to each other in parallel, anode to cathode.

According to one embodiment of the present invention, the LED light control system further comprises an LED light string, the LED light string comprising a plurality of LED pairs, each pair having a first color LED and a second color LED connected to each other in parallel, anode to cathode; a second switching circuit having a plurality of switch states comprising: a first switch state providing a pass-through of an input signal, a second switch state providing a reverse pass-through of the input signal.

According to one embodiment of the present invention, the LED light control system further comprises an LED light string, the LED light string comprising a plurality of LED pairs, each pair having a first color LED and a second color LED connected to each other in parallel, anode to cathode; a second rectifier, a second switching circuit having a second plurality of switch states comprising: a first switch state providing a forward voltage bias from the additional rectifier, a second switch state providing a reverse voltage bias from the additional rectifier.

According to one embodiment of the present invention, the second plurality of switch states further comprises a third switch state providing a pass-through, bypassing the additional rectifier.

According to one embodiment of the present invention, the LED light control system further comprises an LED light string, the LED light string comprising a plurality of LED pairs, each pair having a first color LED and a second color LED connected to each other in parallel, anode to cathode; a second rectifier, a second multi-function generator, a second switching circuit having a second plurality of switch states comprising: a first switch state providing an output of the multi-function generator, a second switch state providing a pass-through, bypassing the rectifier and the multi-function generator.

According to one embodiment of the present invention, an LED light control system comprises a first electrical connection, a second electrical connection, a multifunction generator connected to the second electrical connection, and the multi-function generator is configured to generate at least a forward voltage bias in a first operation mode and a reverse voltage bias in a second operation mode, a rectifier electrically connected between the first electrical connection and the multi-function generator.

According to one embodiment of the present invention, the LED light control system further comprises an LED light string, the LED light string comprising a plurality of LED pairs, each pair having a first color LED and a second color LED connected to each other in parallel, anode to cathode.

According to one embodiment of the present invention, the LED light control system further comprises an LED light string configured to electrically connect to the second electrical connection, the LED light string comprising a plurality of LED pairs, each pair having a first color LED and a second color LED connected to each other in parallel, anode to cathode; a switching circuit which receives an input signal provided by the multi-function generator through the LED light string, the switching circuit having a plurality of switch states comprising: a first switch state providing a pass-through of the input signal, bypassing the multi-function generator, a second switch state providing a reverse pass-through of the input signal, bypassing the multi-function generator.

According to one embodiment of the present invention, the LED light control system further comprises an LED light string configured to electrically connect to the second electrical connection, the LED light string comprising a plurality of LED pairs, each pair having a first color LED and a second color LED connected to each other in parallel, anode to cathode; a second rectifier electrically connected to the second electrical connection through the LED light string, a second multi-function generator electrically connected to the second rectifier, and a second LED light string electrically connected to the second multi-function generator.

BRIEF DESCRIPTION OF THE DRAWINGS

The accompanying drawings illustrate embodiments of the invention and serve as non-limiting examples used to explain the principles of the invention. Like references indicate similar elements among the figures and such elements are illustrated for simplicity and clarity and have not necessarily been drawn to scale. The embodiments illustrated herein are presently preferred, but the invention is not limited to the precise arrangements and combinations shown, wherein.

DETAILED DESCRIPTION OF THE INVENTION

It is often desirable to have multiple LED light strings connected together for use as a lighting display or as part of such a display, such as on a Christmas tree or holiday decoration. In many displays it is also desirable for a lighting string to display a first color (e.g. clear or white) and then discontinue that displayed color in favor of a second color (e.g. blue or a plurality of other colors). In the case of color coordination and switching, it is also desirable to effect such changes easily and in a relatively simple manner. Specifically, the use of a single control point is desirable in larger lighted displays where multiple LED light strings are connected together and color change is to be effected among all such interconnected strings.

Figure 1:
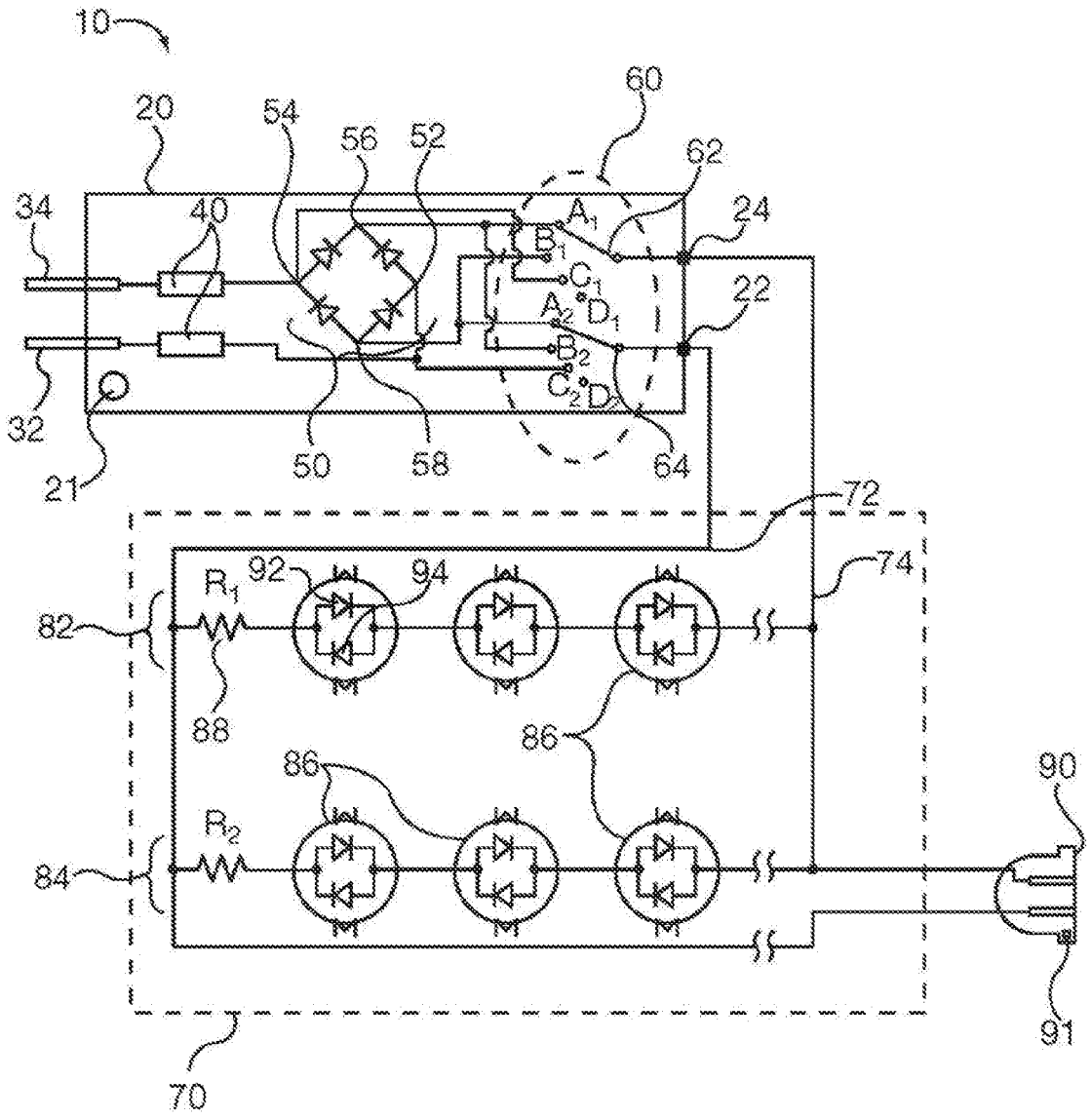
FIG. 1 is a circuit diagram of an LED light string system according to one embodiment of the present invention.

With reference to FIG. 1, a LED light string system 10 is provided containing a controller 20 and a plurality of LED light strings 70. The light string(s) 70 may be organized in any feasible arrangement given the power supply capabilities of the controller 20. As shown in FIG. 1, two blocks of series connected LEDs, 82 and 84, are wired in parallel between electrical connectors 72 and 74. As shown, each block of series connected LEDs contains a plurality of bulbs 86 each containing two LEDs 92 and 94 of two different colors. By way of the example shown in FIG. 1, the "W" and "M" designations next to the LEDs in the bulbs refer to "white" (clear) and "multi-colored" (e.g. blue) respectively. Resistor 88 is optionally included in each series block to provide a current limiting function within the series. Within each bulb, LEDs 92 and 94 are electrically connected to one another anode-to-cathode and cathode-to-anode such that a DC bias voltage applied across connectors 72 and 74 will turn on only one of the LEDs within each bulb. Further, the light string series are arranged such that a DC bias voltage applied across connectors 72 and 74 will turn on simultaneously all the similarly colored LEDs within each light string (i.e. either all white LEDs in the each light string or all colored LEDs in each light string). A forward voltage bias turns on one set of LEDs and a reverse voltage bias turns on the other set of LEDs. (Throughout the specification, "bias" and "voltage bias" are used interchangeably.) Connectors 72 and 74 are terminated at female plug end 90.

Controller 20 is electrically coupled to connectors 72 and 74 at connection points 22 and 24 respectively. Controller 20 has male plug leads 32 and 34 for plugging into a standard 115V AC receptacle or into the female plug end of another LED light string system. Fuses 40 are provided in series with associated electrical connectors coupled to male plug leads 32 and 34 which are then connected to a rectifier 50 at rectifier terminals 52 and 54 respectively. Switching circuit 60 is connected at one side to rectifier terminals 52, 54, 56 and 58 as shown and as further described below. Switching circuit 60 is connected at the other side to connectors 72 and 74 at connection points 22 and 24 respectively. According to one embodiment of the present invention, the switching circuit is implemented as a four-position mechanical switch, as shown in FIG. 1.

As shown, and strictly by way of example, rectifier 50 is a full-wave bridge rectifier having rectifier terminals 52, 54, 56 and 58. Although the operation of full-wave bridge rectifiers is well known to those of skill in the art, a brief description follows. In practice, almost any rectifier (e.g. full-wave, half-wave) or other AC to DC converter can be used operate in circuit position 50 so as to provide a single phase DC voltage at rectifier connection points 56 and 58. The term rectifier is used herein to denote any such device, without limitation, that provides such a function. In operation, an input AC voltage is applied across full-wave bridge rectifier terminals 52 and 54. During one half of the AC power cycle the two diodes on the left-hand side of the bridge are forward biased and the two diodes on the right-hand side of the bridge are reverse biased thereby making a half wave rectification (having a DC component in one phase) available at rectifier terminals 56 and 58. During the other half of AC power cycle the two diodes on the right-hand side of the bridge are forward biased and the two diodes on the left-hand side of the bridge are reverse biased thereby making another half wave rectification (having a DC power component in the same one phase) also available at rectifier terminals 56 and 58. It should be noted that if the output connection to rectifier terminals 56 and 58 is reversed, full wave rectification (the sum of the two half wave rectifications described above) would be provided in the second (other) phase such that the DC power component has an opposite polarity of that of the first phase.

Switching circuit 60 may be any type of electrical switch capable of four different switch states, or making four different connections on the input (switched) side and providing the switched output at connection points 22 and 24. For example, rotary switches, four-position slide switches multiple-push, cycling button switches may all be used for such purposes. As indicated in FIG. 1, the four-position switch has two inputs as provided at terminals 62 and 64 from one of four labeled switch states A, B, C, D corresponding to four different display modes. In switch state A (both switch levers—as shown by dashed lines), rectifier terminals 56 and 58 are connected to the switch output and connection points 24 and 22 respectively. In switch state B (both switch levers), the rectifier terminals are reversed and rectifier terminals 56 and 58 are connected to the switch output and connection points 22 and 24 respectively. In switch state C (both switch levers), the rectifier terminals are bypassed entirely and the switch output and connection points 22 and 24 are connected directly to the power input provided to male plug leads 32 and 34 respectively. In switch state D (both switch levers), no connection to a power input is provided and connection points 22 and 24 remain unpowered and electrically disconnected.

In operation, AC electrical power is provided at male plug leads 32 and 34. In switch state A, full wave rectification is provided at rectifier terminals 56 and 58 in a first phase (polarity) and passed on to connection points 22 and 24. The first phase DC voltage is conducted through the LED light string coupled across connectors 72 and 74 and all of the forward (positively) biased LEDs within each of the bulbs are illuminated. If the LEDs are arranged as described above, then a single (same) color LED will be illuminated in each of the bulbs in each of the series blocks (i.e. all W LEDs or all M LEDs will be illuminated). With the switching circuit in switch state B, full wave rectification is provided at rectifier terminals 56 and 58 in a second phase (opposite polarity of the first phase) and passed on to connection points 22 and 24. The second phase DC voltage is conducted through the LED light string across connectors 72 and 74 and all of the forward (positively) biased LEDs within each of the bulbs are illuminated. If the LEDs are arranged as described above, then a single (same) color LED will be illuminated in each of the bulbs in each of the series blocks, but the LEDs other than those illuminated with the first phase DC voltage applied (i.e. if the W LEDs were illuminated by the first phase DC voltage then the M LEDs will be illuminated by the second phase DC voltage and vice-versa). With the switching circuit in switch state C, no rectification is provided and the input AC (or DC) power provided at male plug leads 32 and 34 is passed directly on to connection points 22 and 24. If the input power is AC then both sets of LEDs (W and M) will light alternately as biased by the appropriate phase of the AC power cycle. In essence, the AC input power simultaneously provides two different DC power components, having two different phases, to the LEDs so that both LEDs appear to illuminate simultaneously. In practical application, the "flicker" that is taking place electrically through the alternation of the phases is likely to be imperceptible to the human eye and the light string will have the appearance of having all the LEDs, W and M, on simultaneously. On the other hand, if the input power is DC with the switch in position C, then only one set of LEDs (W or M) will illuminate depending on the phase of the DC input as described above with respect to switch position A and B. Finally, with the switching circuit in switch state D, no input power is provided to connection points 22 and 24 and all the LEDs remain off Therefore, the four different display modes provided by this embodiment of the invention are white lights, multicolored lights, bypass to control the LED lights with whatever signal (AC or DC) is on the male plug leads 32 and 34, or off with no power provided to the LED lights.

Switch state C can be termed the "follower" position particularly when the DC input to the LED light string system is provided by another (predecessor) LED light string system coupled to plug leads 32 and 34. In this arrangement of series-connected LED light string systems, LEDs (W or M) of the second light string system will follow those illuminated in the first light string system resulting in a uniform illumination color across all such "follower configured" LED light string systems. To aid with this coordination of color matching, polarity dots 21 and 91 are provided on controller 20 and female plug end 90 respectively. Thus, if the polarity dots of consecutively connected LED light string systems are matched at each plug interface and the switch setting of the second and all subsequent LED light string systems are at C, the same polarity will be maintained at the same terminals of each string and all the same color LEDs (W or M) will illuminate in unison throughout the entire plurality of light string systems according to the switch setting of the controller on the first LED light string system.

Those of skill in the art will appreciate that numerous convoluted lighting schemes may be achieved by switching controllers to different settings (i.e. not necessarily switching all follower LED light strings to a "following" switch state C) at different points in the series of connected LED light string systems.

Figure 2:
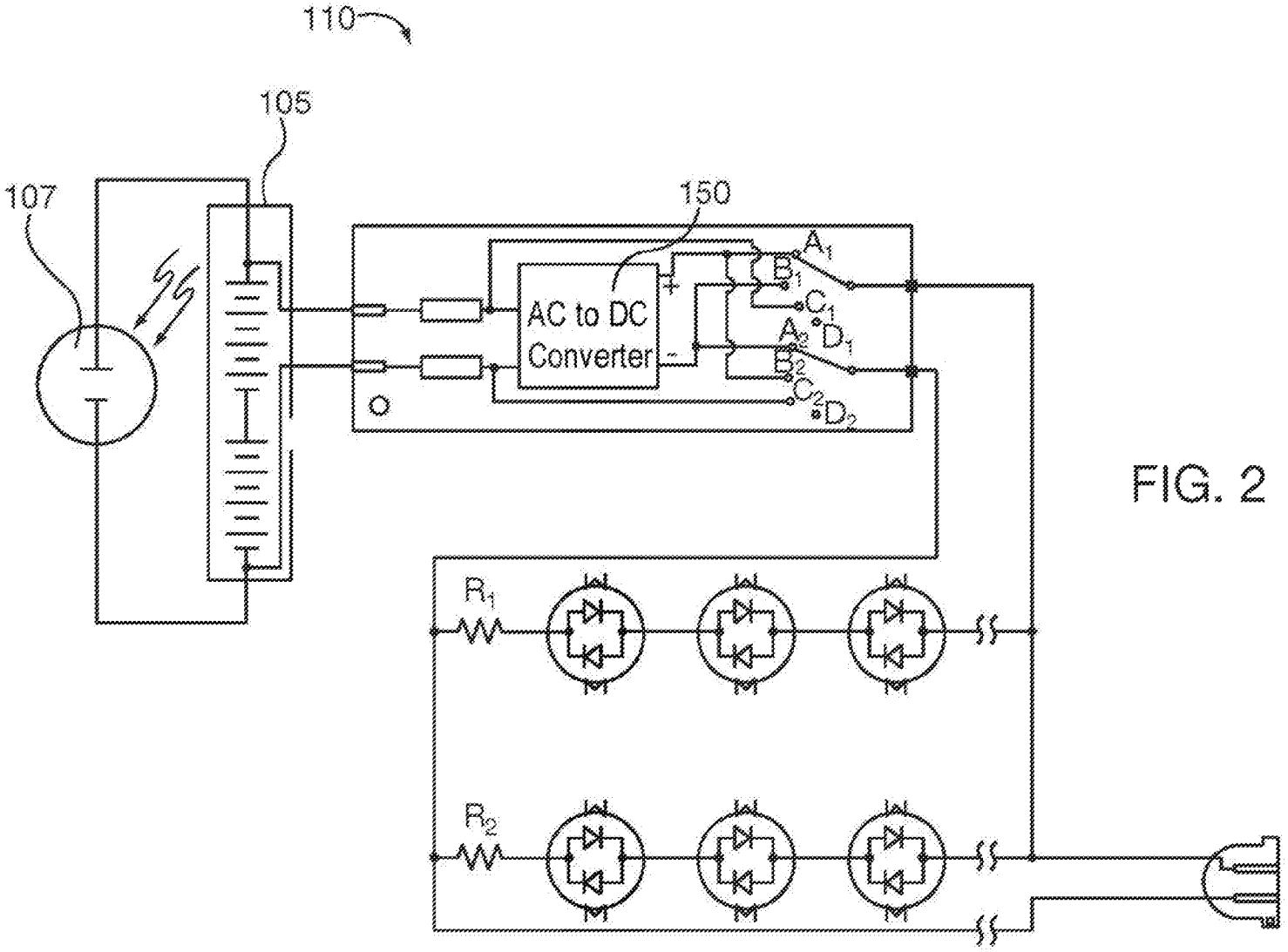
FIG. 2 is a circuit diagram of an LED light string system according to an alternative embodiment of the present invention.
Figure 3:
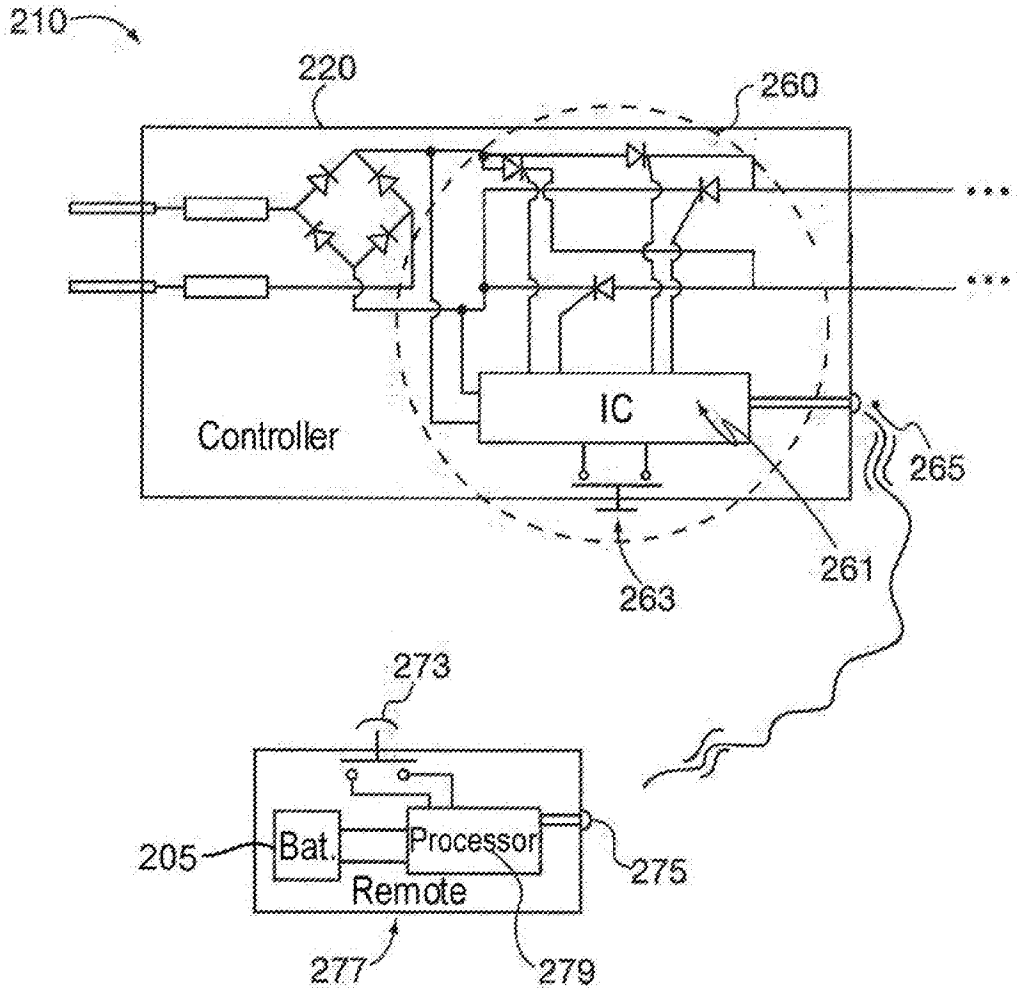
FIG. 3 is a diagram of a portion of an LED light string system according to an additional alternative embodiment of the present invention.
Figure 4:
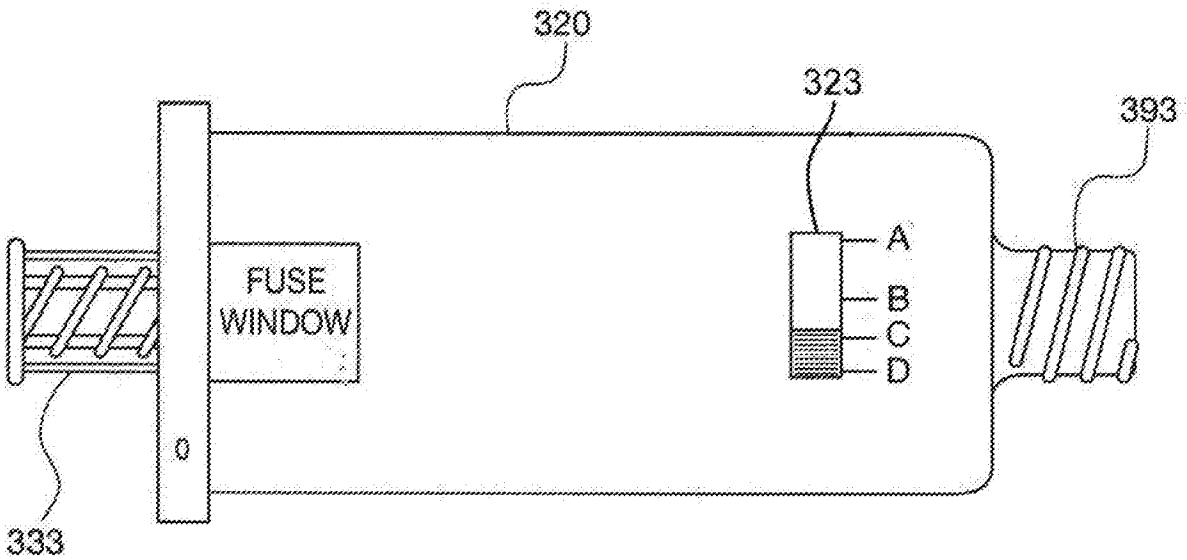
FIG. 4 is a side view of a separable controller for use with an LED light string system according to one embodiment of the present invention.

Although the physical construction and electrical circuit layout of FIG. 1 have been specifically disclosed, those of skill in the art will appreciate that alternative physical constructions and electrical arrangements may exist to accomplish the above-described functions without departing from the teaching of the present invention. Referring to FIG. 2, a low voltage AC to DC converter 150 may be substituted for the full-wave bridge rectifier 50. In one particularly preferred embodiment, a 12 or 24 volt DC output is provided by the low voltage AC to DC converter. Further, battery 105 may provide the input DC power for LED light string system 110 and the battery may be charged by optional solar cell 107. Referring to FIG. 3, four-position switch of controller 220 may be replaced with an integrated circuit 261 and associated circuitry (all within the switching circuit 260) wherein the integrated circuit 261 is cycled through the four display modes with a push-button switch 263. Alternatively or in addition, remote control capability may be added for switching the controller. Wireless receiver/transmitter head 265 may be included in controller 220 for coordinating wireless communication with remote 277 having its own wireless receiver/transmitter head 275. Push-button switch 273 on the remote is used to switch among the controller display modes in this embodiment and wireless signals exchanged between the receiver/transmitter heads 265 and 275 include switch position information and convey switch transition information for interpretation and execution by switching circuit 260 and the wireless remote processor 279. Finally, the controller 20 may be removed from male plug leads 32 and 34 (which may be part of a typical AC male plug) and located at different positions within the LED light string cord. Alternatively, and referring to FIG. 4 the controller 320 may be an entirely separate component of the LED light string system for configurable connection to any one of a number of power inputs and LED light strings to be controlled. In one particularly preferred embodiment, the female plug end 90 is replaced by standardized connector 393 (shown as a screw-in connection in FIG. 4) that automatically maintains proper polarity alignment via a connector capable of only a single coupling orientation. A cap piece 333 may be provided so as to be mateably connected with the male plug ends to allow for chaining LED light string systems in series. A four-position slide switch 323 allows the user to select the operating mode.

Figure 5:
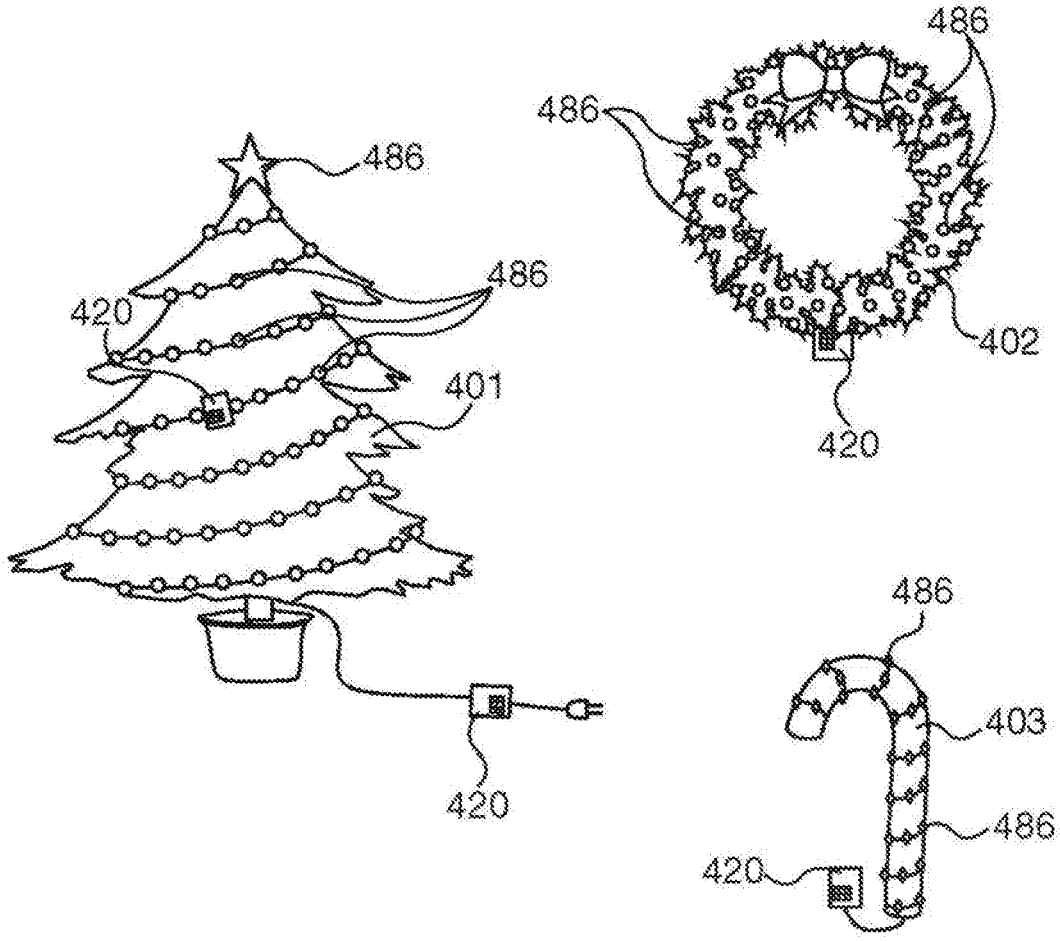
FIG. 5 provides a diagram illustrating a practical application of the LED light string system according to the teachings of the present invention.
Figure 6:
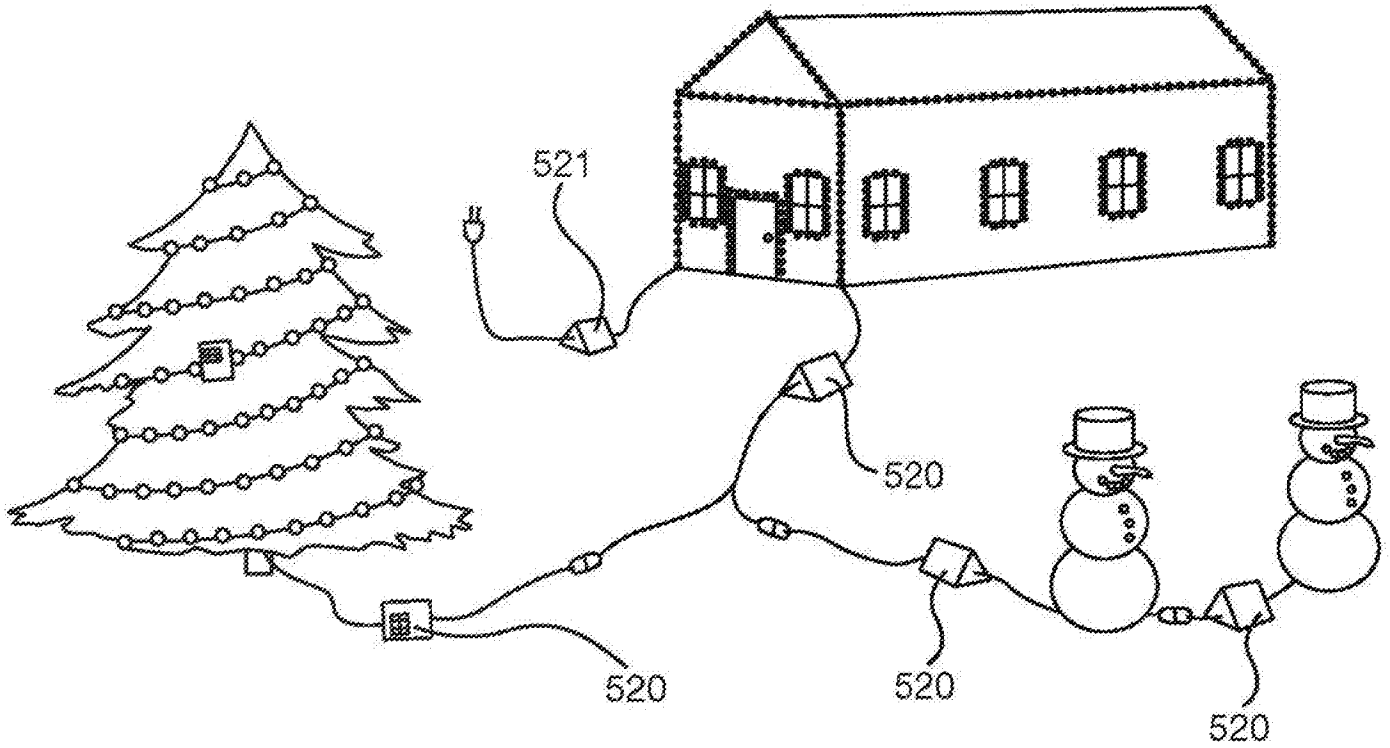
FIG. 6 provides another diagram illustrating a practical application of the LED light string system according to the teachings of the present invention.

In practical application, referring to FIG. 5, the LED light string systems of the present invention may be used on any type of holiday decorations, such as Christmas trees 401, wreaths 402, and other lighted holiday ornamentation 403. Each of these may require one or more LED light string systems to achieve the desired lighting effect. Dual color LED bulbs 486 controlled by controllers 420 may operate independent of each other as shown in FIG. 5, or they may be interconnected and properly switched at each controller to achieve a more coordinated effect as shown in FIG. 6. As shown there, a master controller 521 may be switched to setting A or B while all other controllers 520 may be switched to setting C to "follow" the polarity and presumably the display mode selected by the master controller. All the "follower" LED light strings do not necessarily have to be of the same color or even a coordinated color depending on the desired lighting effect design, but interconnection of all the LED light strings ensures that "follower strings" have the capability of matching the LED color (through DC voltage phase pass through as selected by the master controller).

Figure 7:
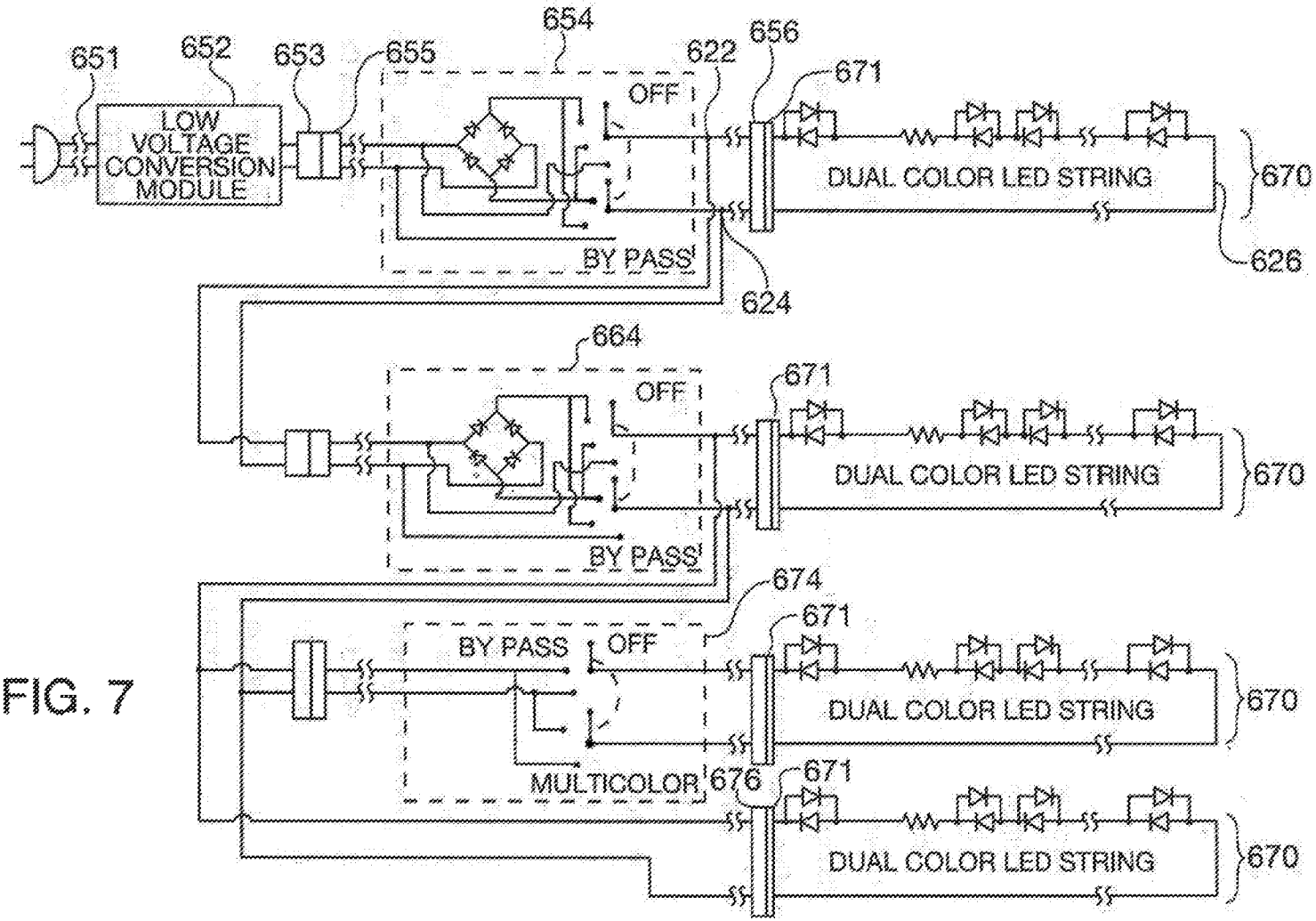
FIG. 7 provides a circuit diagram of several LED light string systems connected together according to another embodiment of the present invention.
Figure 8:
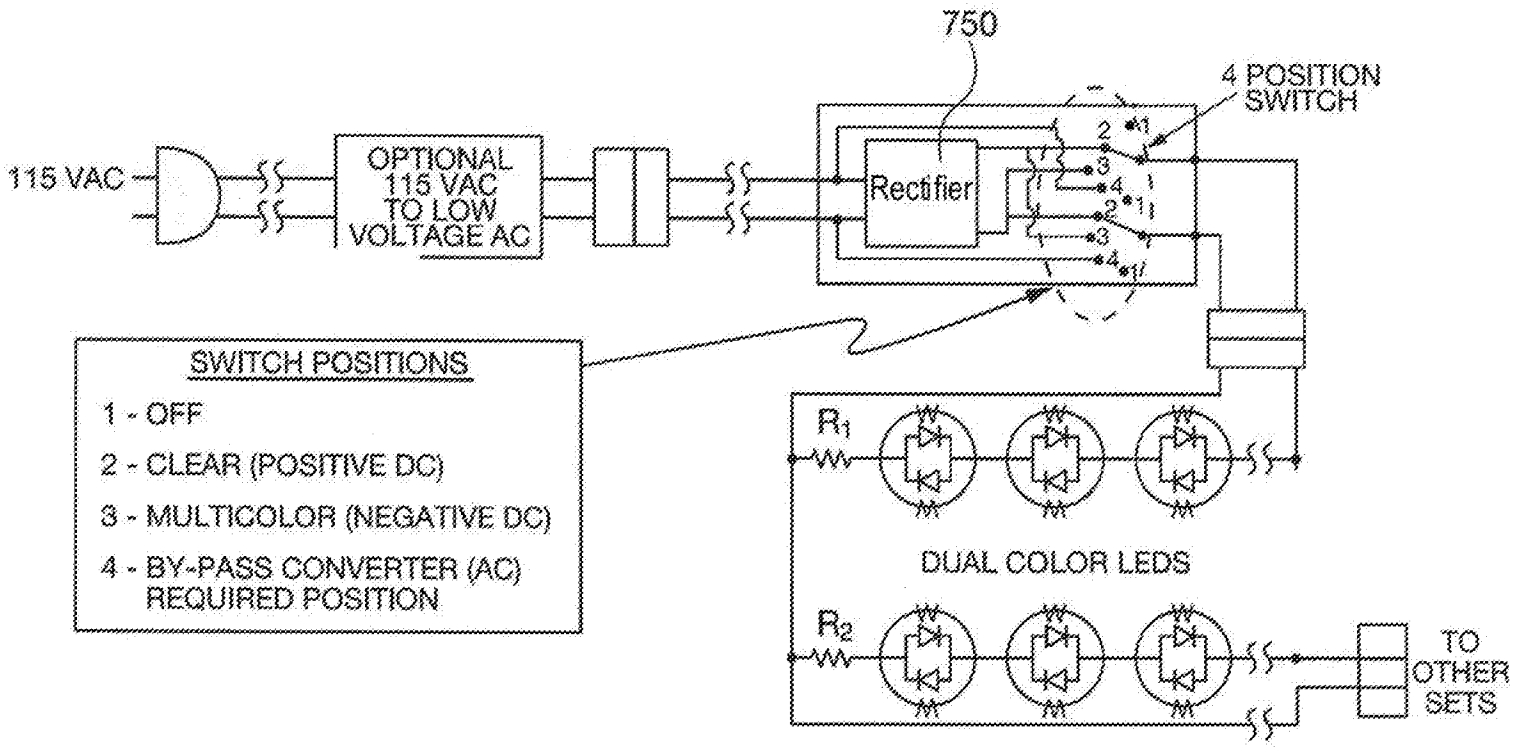
FIG. 8 provides a circuit diagram of an LED light string system according to another embodiment of the present invention.

In one commercially important regard, consumer safety concerns are critical to and omnipresent in the proper design of electronic consumer goods. As such, it is highly desirable to provide a low voltage lighting system in which most all connections within the lighting system are made at a low distributed voltage such that the lighting system significantly and substantially operates at that low voltage. FIGS. 7 and 8 illustrate one embodiment of the light string system of the present invention in which this objective is achieved.

As shown in FIG. 7, the high-to-low voltage conversion and rectification functions originally provided in block 150 in FIG. 2 have been separated into two separate and discrete functions: voltage conversion, as provided in the high-to-low voltage conversion module 652, and rectification and switching, as provided in module 654. The high-to-low voltage conversion module is connected at a first connection 651 to a high voltage power source, such as a typical 115V AC power outlet. The high-to-low voltage conversion module 652 is connected at a second connection 653 to rectification and switching module 654 at its first connection 655. Connections 653 and 655 may be either polarized, meaning that they have only one connection orientation, or unpolarized. High-to-low voltage conversion module 652 may be composed of any known or heretofore developed commercial voltage converters such as those provided by power converters, power inverters, power adapters, or transformers.

The remaining portions of the light system, beyond the high-to-low voltage conversion module 652, consists of a plurality of light strings 670, each of which have a polarized connector (or plug) 671 at one end. These light strings may be coupled to rectification and switching module 654 in any of a number of configurations. In one arrangement, shown at the top of FIG. 7, rectification and switching module 654 is disposed between the high-to-low voltage conversion module 652 and the light string 670. At a first connection 655, the rectification and switching module is connected to second connection 653 of high-to-low voltage conversion module 652, and at a second, polarized connection, 656, rectification and switching module 654 is connected to the polarized connection 671 of the light string. In another arrangement, rectification and switching module 664 is connected in series with previous rectification and switching module 654 at the same polarized connection, 656 (or other similarly constructed connection point at that point in the circuit). In yet another arrangement, light strings 670 may be directly connected in series with first rectification and switching module 654, or other similarly constructed connection point at that point in the circuit.

It should be recognized that connection points 622 and 624 may be at any of a number of a plurality of points along the first dual color light string 670, including but not limited to the other end of the light string 626 from its connection to the rectification and switching module 654. In this regard, the light strings can be coupled in series, through a plurality of intervening rectification and switching modules, or in parallel, one each through its own rectification and switching module, e.g. 664, or entirely without any subsequent coupling to additional rectification and switching modules, e.g. 676.

With respect to the rectification and switching modules 654, 664, 674, and as mentioned above, any type of rectifier and switch combination may be contained within those modules. For example, the rectification portion of the module may consist of a full-wave rectifier, a half-wave rectifier, or an integrated circuit that provides the same function, as shown at 750 FIG. 8. With respect to the switching circuit of the module, any of several types of mechanical switches may be employed such as a rotary switch, sliding switch, or a sequenced step switch with the actual switching function provided by mechanical connections to the switch activation mechanism or a switching circuit contained within an integrated circuit activated by any of the above-mentioned mechanical activation mechanisms, or activated electronically. Further, switches with a different number of poles may be employed at different points in the overall system to achieve different effects. For example, four-state switches (e.g. first voltage phase, second voltage phase, pass-through/bypass, and off) may be coupled to some light strings, e.g. 654 and 664, while three-state switches (e.g. first voltage phase, second voltage phase, and either pass-through/bypass or off) may be coupled to other light strings, e.g. 674.

In one particularly advantageous aspect of the invention, low-powered voltage signals are presented to the entire lighting system at the system head end, after which the first rectification and switching module can be set to one or another particular phase, or turned off entirely. Given this arrangement, all other rectification and switching modules may be set to a pass-through/bypass mode such that the same low voltage, uniphase signal and display mode generated by the first rectification and switching module is reliably presented to each of the other light strings by virtue of the polarized connections therebetween and the pass-through settings of any intervening rectification and switching modules.

It is worth noting that when several controllers comprising a rectifier and a switching circuit are chained together, each controller is able to produce a forward voltage bias in the first switch state, and a reverse voltage bias in the second switch state regardless of the polarity or voltage bias on the inputs. This is because the rectifier, rectifies the input voltage to the same polarity on the rectifier outputs regardless of the polarity on the inputs. This allows each light string to be set to one color or another independently of the other light strings, or be set to follow the light string immediately before it. Setting a light string to one display mode or another need not necessarily affect the display mode of subsequent light strings unless that behavior is desired and appropriately set using the switching circuit.

Figure 9:
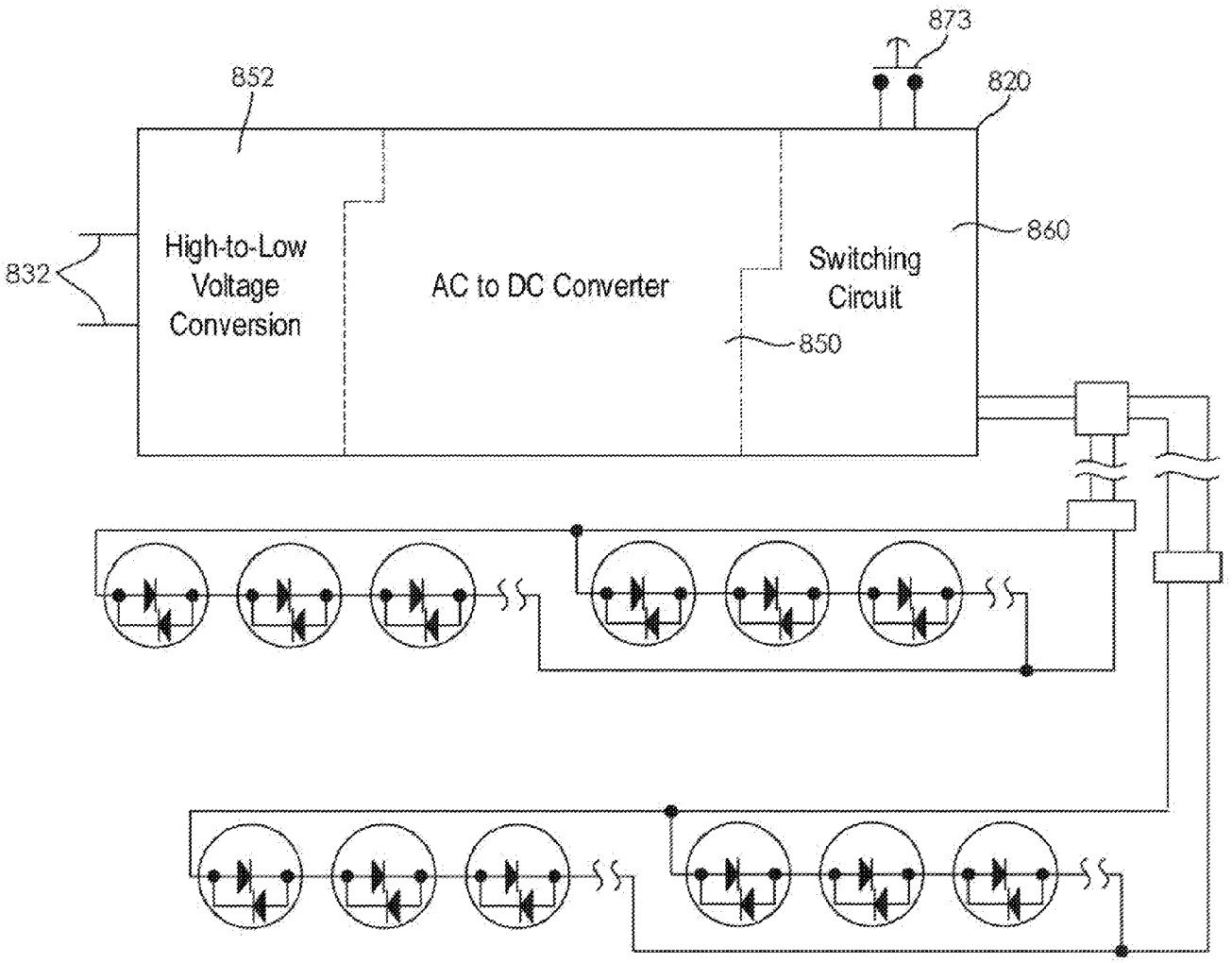
FIG. 9 is a circuit diagram of an LED light string system with combined high to low voltage AC module, AC to DC converter, and switch module according to an alternative embodiment of the present invention.

FIG. 9 shows an alternate embodiment of the present invention, where the high-to-low voltage conversion module 852, AC to DC converter 850, and switching circuit 860 controlled by a pushbutton switch 873 are all combined into a single controller 820 which plugs into a wall outlet by the blade terminals 832. One of ordinary skill in the art would recognize that the various components could be rearranged or divided into subparts and achieve the same result without departing from the spirit and scope of the present invention.

Figure 10:
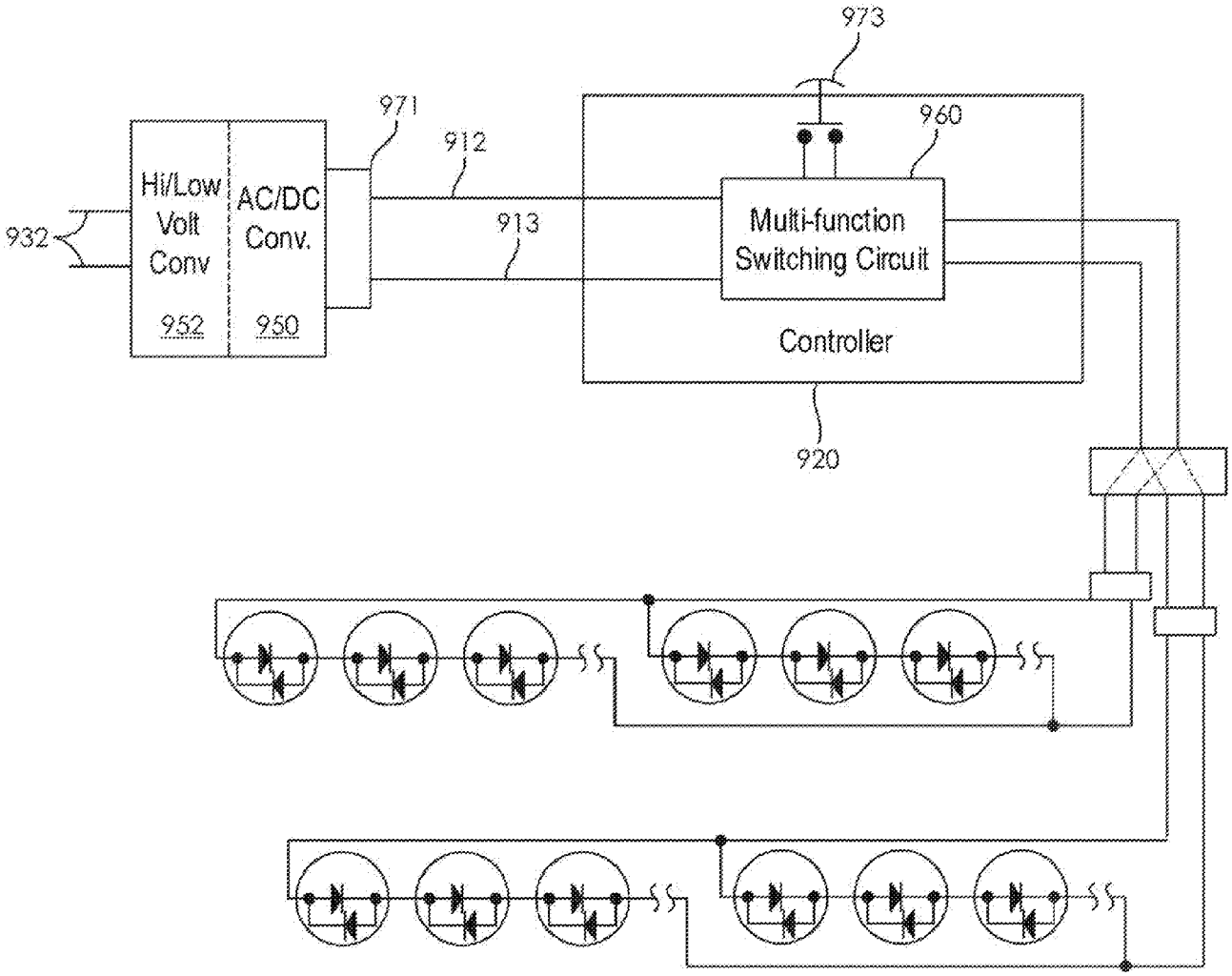
FIG. 10 is a circuit diagram of an LED light string system with a multi-function electronic switch module according to an embodiment of the present invention.

FIG. 10 shows an alternate embodiment of the present invention, where the high-to-low voltage conversion module 952, and AC to DC converter 950 are separated from the controller 920 and DC power is passed through a connector 971 to a multi-function switching circuit 960 by DC leads 912 and 913. The multi-function switching circuit 960 in this particular embodiment receives input from the pushbutton switch 973 and cycles through a variety of different switch states producing different display modes, including but not limited to, a forward voltage bias, reverse voltage bias, bypass or pass-through, alternating slowly or rapidly between forward voltage bias and reverse voltage bias, fading, strobing, flashing, off, or any combination. This embodiment can also be combined with additional LED light strings, and optionally with additional controllers shown in FIG. 4 as well, to create a variety of different lighting effects or a series of LED light strings which all follow the output of the multi-function switching circuit 960. According to on embodiment of the present invention, the display modes aren't necessarily produced by switching to various different connections, but can instead be produced by a multi-function generator which takes input from the switching circuit to determine which display mode function to generate.

Figure 11:
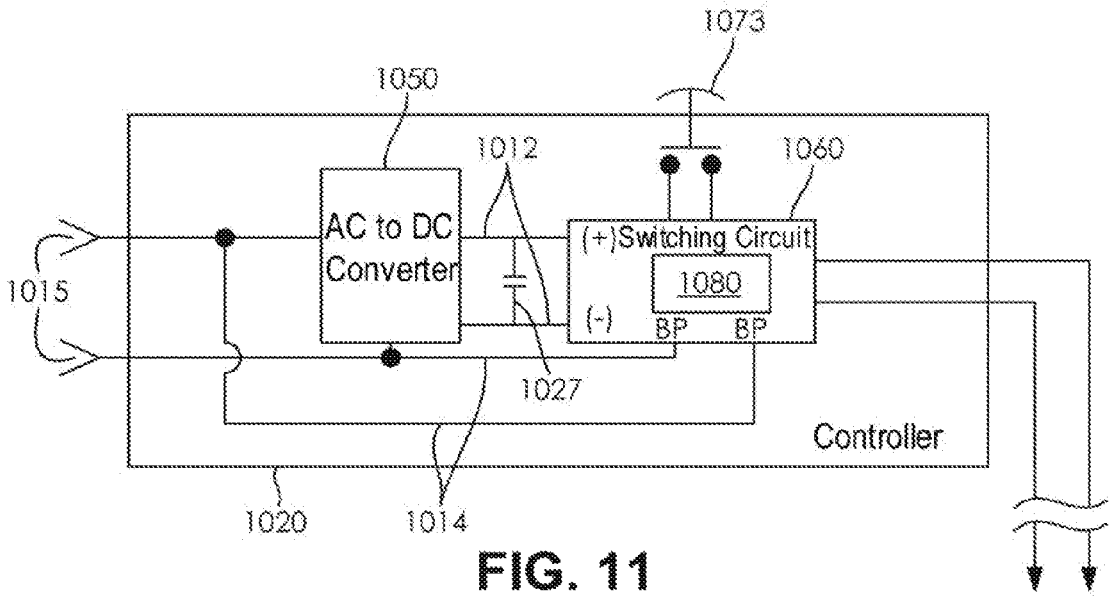
FIG. 11 is a circuit diagram of a portion of an LED light string system with an AC to DC converter and electronic switch module with inputs that bypass the AC to DC converter according to an embodiment of the present invention.

FIG. 11 shows an alternate embodiment of the present invention with a controller 1020 that includes an electronic switching module acting as the switching circuit 1060. The switching circuit 1060 takes one set of inputs from an AC to DC converter 1050 through DC leads 1012. The electronic switching circuit 1060 also takes another set of inputs from bypass leads 1014 which bypass the AC to DC converter 1050, bringing a signal directly from the power input leads 1015. The electronic switching circuit 1060 responds to the pushbutton switch 1073 by cycling through the switch states to provide display modes enabled by a forward voltage bias, reverse voltage bias, and bypass or pass-through states.

The switching circuit 1060 may alternatively include a multifunction generator 1080. The multifunction generator 1080 is powered by the output of the AC to DC converter 1050 and is capable of producing a variety of output functions which drive the LED lights on the light string to produce corresponding display modes. These output functions include, but are not limited to, a forward voltage bias, reverse voltage bias, alternating slowly or rapidly between forward voltage bias and reverse voltage bias, fading, strobing, flashing, off, or any combination of these functions. According to an embodiment of the present invention, a one or more capacitors 1027 are provided at the output of the AC to DC converter 1050 in order to smooth any voltage fluctuations in the power supplied to the multi-function generator 1080. Such voltage fluctuations may be created by a previous multi-function generator. The switching circuit 1060 as a whole is capable of producing the output generated by the multifunction generator 1080, bypassing the AC to DC converter 1050 via bypass leads 1014, or reversing the polarity of the bypass leads 1014. The AC to DC converter 1050 takes whatever signal is on the power input leads and rectifies it to a DC signal. The signal on the power input leads may be one of any of the signals produced by the multifunction generator 1080 and switching circuit 1060 of a previous controller.

Figure 12:
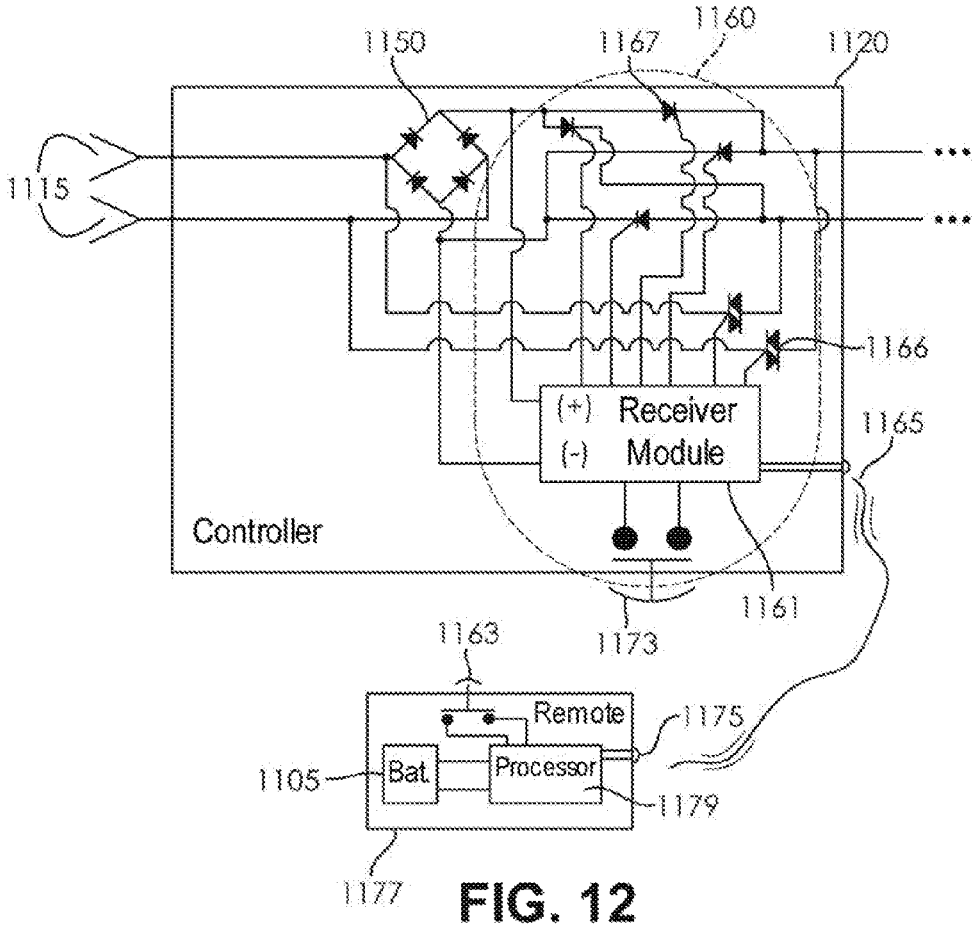
FIG. 12 is a circuit diagram of a portion of an LED light string system with a full wave bridge rectifier and electronically controlled switching circuit and optional remote control according to an embodiment of the present invention.

FIG. 12 shows how the switching circuit 260 of FIG. 3 can be expanded to include a bypass function as well. Power from the power input leads 1115 can be routed around the full-wave bridge rectifier by the switching circuit 1160 and directed to the outputs. In this particular embodiment, the receiver module 1161 receives commands either from the pushbutton switch 1173 or the wireless antenna 1165. These commands cause the receiver module to turn on and off the various Silicon Controlled Rectifiers (SCRs) 1167, allowing them to conduct current. In this manner, controller 1120 produces an output of forward voltage bias, reverse voltage bias, or bypasses the rectifier altogether.

An optional remote 1177 allows changing the display mode of the light string without using the pushbutton switch 1173. A remote pushbutton switch 1163 is used to send commands to the wireless remote processor 1179, which sends the commands by the transmitter head 1175 to the wireless antenna 1165 or receiver in the light string controller 1120. The remote 1177 is powered by a battery 1105. The remote 1177 can be configured to send simple commands to cycle through the available switch states that produce different display modes, or send more complex commands to turn on or off the lights, or pick a particular display mode without having to cycle through other display modes.

The wireless antenna 1165 may be replaced with an optical receiver or other wireless communications device. SCRs 1167 are turned on or off by control signals generated by the receiver module 1161. The SCRs may be replaced with transistors, relays, or other functionally equivalent devices to accomplish the function of the switching circuit. TRIACs 1166, which are turned on or off by control signals from the receiver module 1161, are used on the bypass wires to allow for the possibility of an alternating current to pass through. The TRIACs 1166 could also be replaced with functionally equivalent combinations of transistors, relays, SCRs or other electronic components. As mentioned before, the full-wave bridge rectifier 1150 can be replaced with any AC to DC converter. One of ordinary skill in the art would recognize that various parts of the light string controller could be swapped for other parts or rearranged while still achieving the same result without departing from the spirit and scope of the present invention.

Figure 13:
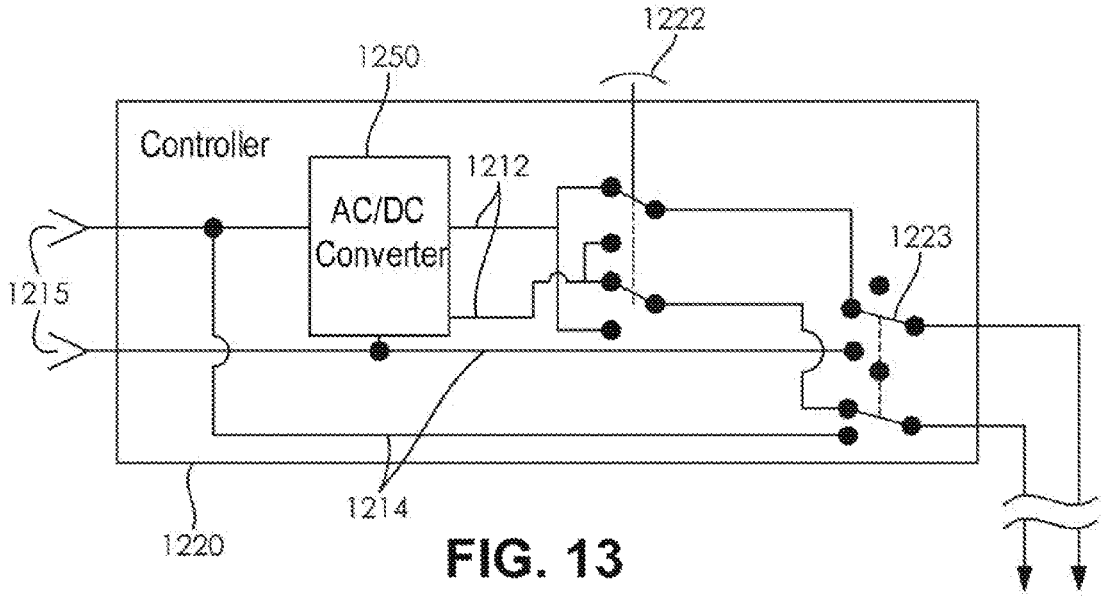
FIG. 13 is a circuit diagram of a portion of an LED light string system where the switching circuit comprises a plurality of switches according to an embodiment of the present invention.

FIG. 13 shows an alternate embodiment of the present invention where the switching circuit comprises two switches. A two position switch produces a forward or reverse voltage bias from the DC leads 1212 on the output of the rectifier or AC to DC converter 1250. A three-position switch 1223 chooses between the off state, the output of the two-position switch 1222, and bypass leads 1214 which are connected to the power input leads 1215.

Is it also possible in the controller 1220 of FIG. 13 to swap the positions of the two-position switch 1222 and three position switch 1223. In this embodiment, the three position switch chooses between the off state, the outputs of the AC to DC converter 1250 and the bypass leads 1214 which would still be connected to the power input leads 1215. The two-position switch 1223 then chooses between passing the output of the three-position switch directly through, or reversing the polarity to produce a total of five switch states with associated display modes: forward voltage bias, reverse voltage bias, pass-through, reverse pass-through (reversing the polarity of the inputs on the outputs), and off.

Figure 14:
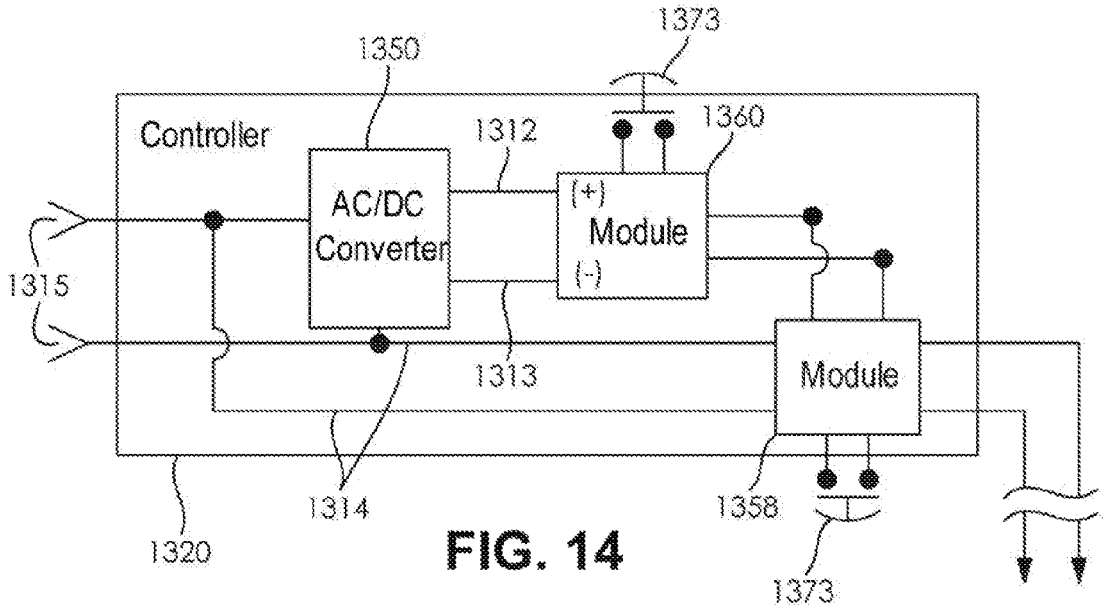
FIG. 14 is a circuit diagram of a portion of an LED light string system where the switching circuit comprises a plurality of electronic switches according to an embodiment of the present invention.

FIG. 14 is identical to FIG. 13, except that the two-position switch 1222 is replaced by an electronic switching module 1360, and the three-position switch 1223 is replace by an electronic bypass module 1358. The switching circuit is made up of the combination of the electronic switching module 1360 and the electronic bypass module 1358. The electronic modules 1360 and 1358 are each controlled by a pushbutton switch 1373 which is used to cycle through the available switch states and associated display modes. Like numbers refer to like components in FIG. 13 and FIG. 14, and the same operation principles and alternate arrangement possibilities as described with respect to FIG. 13 apply.

Figure 15:
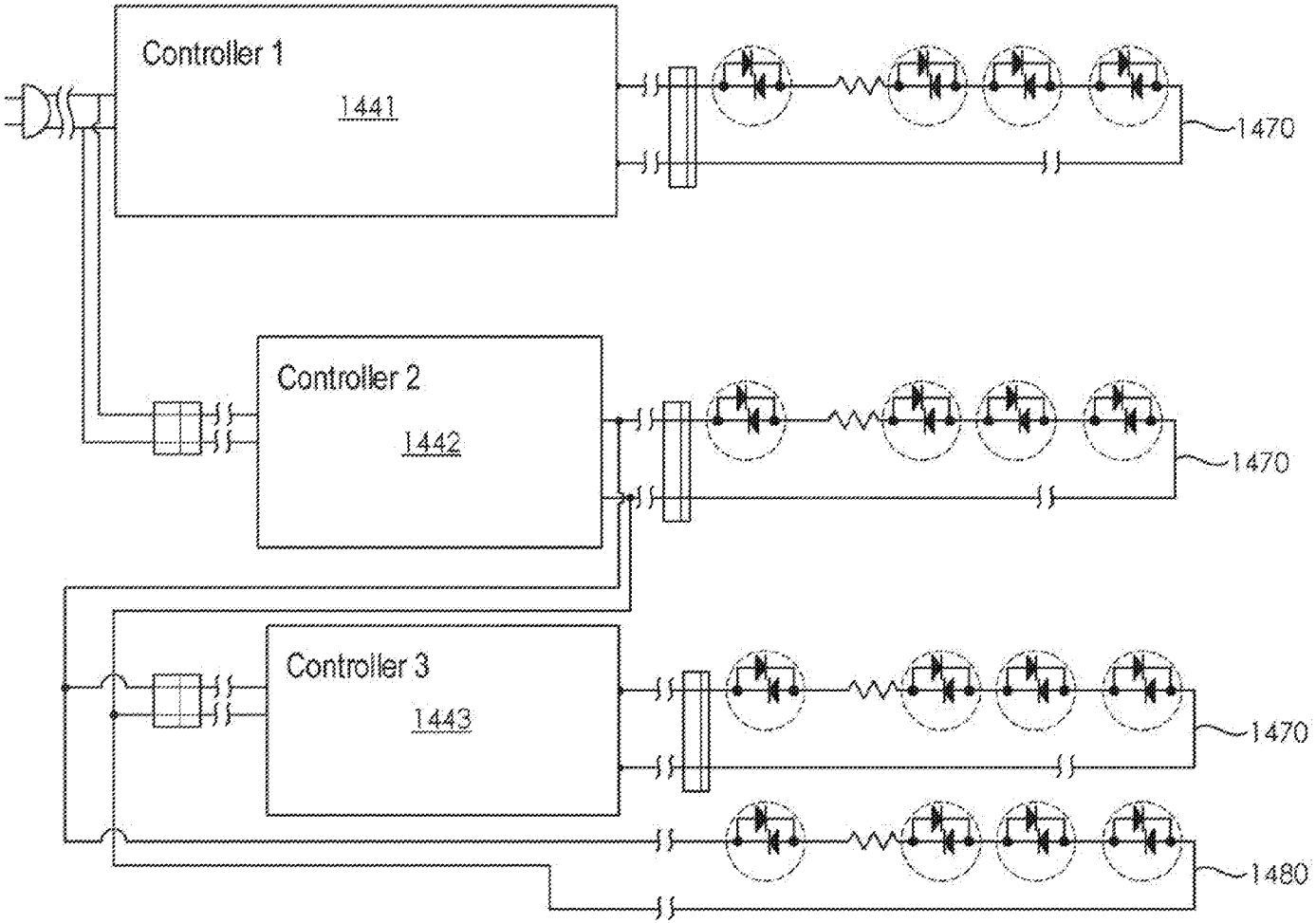
FIG. 15 is a circuit diagram of several generalized LED light strings connected together to illustrate the flexibility and various connection options according to an embodiment of the present invention.

According to an embodiment of the present invention, FIG. 15 shows a schematic diagram of several LED light systems connected using various connection options. Controller 1 1441 and controller 2 1442 are both connected to the same power source and operate independently of each other. Controller 3 1443 is connected to the output of controller 2 1442 so that controller 3 has the option of following the display mode of controller 2 1442. Controller 3 1443 may be the alternate embodiment of the controller 1220 described with reference to FIG. 13, allowing controller 3 1443 to follow or reverse the output of controller 2 1442, or produce a forward or reverse voltage bias independently of controller 2 1442. One or more additional lights strings 1480 may also be connected without their own controller. These additional light strings 1480 would either follow or reverse the display mode of the controller they are attached to depending on the polarity of the connection. To aid with this coordination of color matching, as depicted in FIG. 1, polarity dots 21 and 91 are provided on controller 20 and female plug end 90 respectively.

Throughout this specification and claims, the phrase "configured to electrically connect" or its variants shall be interpreted to mean, electrically connected, or configured to plug into or otherwise make an electrical connection with. In other words, electrically connected shall be included within the definition of "configured to electrically connect" and its variants.

While the invention has been shown and described with reference to specific preferred embodiments, it should be understood by those skilled in the art that various changes in form and detail may be made therein without departing from the spirit and scope of the invention as defined by the following claims.

What is claimed is:

1. An LED light control system comprising:
a first electrical connection,
a second electrical connection,
a multi-function generator having an output, and
a primary switching circuit having a plurality of switch states comprising:
a first switch state providing a pass-through from said first electrical connection to said second electrical connection,
a second switch state providing said output of said multi-function generator to said second electrical connection; and
a second switching circuit configured to electrically connect to said LED light control system, said second switching circuit having a second plurality of switch states comprising:
a first switch state providing a pass-through of an input signal,
a second switch state providing a reverse pass-through of said input signal.

2. An LED light control system comprising:
a first electrical connection,
a second electrical connection,
a multi-function generator having an output, and
a primary switching circuit having a plurality of switch states comprising:
a first switch state providing a pass-through from said first electrical connection to said second electrical connection,
a second switch state providing said output of said multi-function generator to said second electrical connection;
a third switch state providing a reverse pass-through from said first electrical connection to said second electrical connection.

3. The LED light control system of claim 1 further comprising an LED light string configured to electrically connect to said second electrical connection, said LED light string comprising a plurality of LED pairs, each pair having a first color LED and a second color LED connected to each other in parallel, anode to cathode.

4. The LED light control system of claim 1 further comprising:
an LED light string, said LED light string comprising a plurality of LED pairs, each pair having a first color LED and a second color LED connected to each other in parallel, anode to cathode.

5. An LED light control system further comprising:
a first electrical connection,
a second electrical connection,
a multi-function generator having an output, and
a primary switching circuit having a plurality of switch states comprising:
a first switch state providing a pass-through from said first electrical connection to said second electrical connection,
a second switch state providing said output of said multi-function generator to said second electrical connection;
a third electrical connection,
an LED light string, said LED light string comprising a plurality of LED pairs, each pair having a first color LED and a second color LED connected to each other in parallel, anode to cathode;
a rectifier, and
a second switching circuit electrically connected to said rectifier, said second switching circuit having a second plurality of switch states comprising:
a first switch state providing a forward voltage bias from said rectifier to said third electrical connection, and
a second switch state providing a reverse voltage bias from said rectifier to said third electrical connection.

6. The LED light control system of claim of claim 5 wherein said second plurality of switch states further comprise:
a third switch state providing a pass-through to said third electrical connection, bypassing said rectifier.

7. An LED light control system further comprising:
a first electrical connection,
a second electrical connection, a multi-function generator having an output, and a primary switching circuit having a plurality of switch states comprising:

a first switch state providing a pass-through from said first electrical connection to said second electrical connection, a second switch state providing said output of said multi-function generator to said second electrical connection;

an LED light string, said LED light string comprising a plurality of LED pairs, each pair having a first color LED and a second color LED connected to each other in parallel, anode to cathode;

a rectifier, a second multi-function generator electrically connected to said rectifier, and a second switching circuit electrically connected to said rectifier and electrically connected to said second multi-function generator, said second switching circuit having a second plurality of switch states comprising:

a first switch state providing an output from said multi-function generator, a second switch state providing a pass-through of an input signal, bypassing said rectifier and said multi-function generator.

8. An LED light control system comprising:

a first electrical connection, a second electrical connection, a rectifier electrically connected to said first electrical connection, a multifunction generator electrically connected to said rectifier, a primary switching circuit having a plurality of switch states comprising:

a first switch state providing an output of said multi-function generator to said second electrical connection a second switch state providing an operating output to said second electrical connection other than from said multifunction generator;

a second switching circuit having a plurality of switch states comprising:

a first switch state providing a pass-through of an input signal, a second switch state providing a reverse pass-through of said input signal.

9. The LED light control system of claim 8 wherein said second switch state provides an output from said rectifier.

10. The LED light control system of claim 8 wherein said second switch state provides a pass-through from said first electrical connection to said second electrical connection, bypassing said rectifier.

11. The LED light control system of claim 10 wherein said multi-function generator is configured to generate a DC output.

12. The LED light control system of claim 8 further comprising an LED light string, said LED light string comprising a plurality of LED pairs, each pair having a first color LED and a second color LED connected to each other in parallel, anode to cathode.

13. The LED light control system of claim 8 further comprising:

an LED light string, said LED light string comprising a plurality of LED pairs, each pair having a first color LED and a second color LED connected to each other in parallel, anode to cathode.

14. The LED light control system of claim 8 further comprising:

a second rectifier, a second switching circuit having a second plurality of switch states comprising:

a first switch state providing a forward voltage bias from said additional rectifier, a second switch state providing a reverse voltage bias from said additional rectifier.

15. The LED light control system of claim 14 wherein said second plurality of switch states further comprise:

a third switch state providing a pass-through, bypassing said additional rectifier.

16. The LED light control system of claim 8 further comprising:

a second rectifier, a second multi-function generator, a second switching circuit having a second plurality of switch states comprising:

a first switch state providing an output of said multi-function generator, a second switch state providing a pass-through, bypassing said rectifier and said multi-function generator.

17. An LED light control system comprising:

a first electrical connection, a second electrical connection, a multifunction generator connected to said second electrical connection, and said multi-function generator is configured to generate at least a forward voltage bias in a first operation mode and a reverse voltage bias in a second operation mode, a rectifier electrically connected between said first electrical connection and said multi-function generator, a second rectifier electrically connected to said second electrical connection through said LED light string, a second multi-function generator electrically connected to said second rectifier, and a second LED light string electrically connected to said second multi-function generator.

18. The LED light control system of claim 17 further comprising an LED light string, said LED light string comprising a plurality of LED pairs, each pair having a first color LED and a second color LED connected to each other in parallel, anode to cathode.

19. The LED light control system of claim 17 further comprising:

an LED light string configured to electrically connect to said second electrical connection, said LED light string comprising a plurality of LED pairs, each pair having a first color LED and a second color LED connected to each other in parallel, anode to cathode;

a switching circuit which receives an input signal provided by said multi-function generator through said LED light string, said switching circuit having a plurality of switch states comprising:

a first switch state providing a pass-through of said input signal, bypassing said multi-function generator, a second switch state providing a reverse pass-through of said input signal, bypassing said multi-function generator.

20. The LED light control system of claim 17 further comprising:

an LED light string configured to electrically connect to said second electrical connection, said LED light string comprising a plurality of LED pairs, each pair having a first color LED and a second color LED connected to each other in parallel, anode to cathode.

* * * * *